United States Patent [19]

Smith et al.

[11] 4,321,165

[45] Mar. 23, 1982

[54] DETERGENT COMPOSITIONS COMPRISING CATIONIC, ANIONIC AND NONIONIC SURFACTANTS

[75] Inventors: Rory J. M. Smith, Rowlands Gill; Allan C. McRitchie, Blyth, both of England

[73] Assignee: The Procter & Gamble Company, Cincinnati, Ohio

[21] Appl. No.: 154,717

[22] Filed: May 30, 1980

Related U.S. Application Data

[63] Continuation of Ser. No. 919,537, Jun. 26, 1978, abandoned.

[30] Foreign Application Priority Data

Jun. 29, 1977 [GB] United Kingdom ..... 27275/77

[51] Int. Cl.[3] ..... C11D 1/86; C11D 1/65

[52] U.S. Cl. ..... 252/528; 252/526; 252/545; 252/547; 252/531; 252/539; 252/550; 252/558

[58] Field of Search ..... 252/8.8, 106, 528, 531, 252/539, 540, 547, 550, 558, 559

[56] References Cited

U.S. PATENT DOCUMENTS

| | | | |
|---|---|---|---|
| 3,044,962 | 7/1962 | Brunt et al. | 252/110 |
| 3,360,470 | 12/1967 | Wixon | 252/99 |
| 4,058,489 | 11/1977 | Hellsten | 252/547 |
| 4,132,680 | 1/1979 | Nicol | 252/547 |

FOREIGN PATENT DOCUMENTS

| | | |
|---|---|---|
| 818419 | 7/1969 | Canada . |
| 2433079 | 2/1975 | Fed. Rep. of Germany . |
| 641297 | 8/1950 | United Kingdom . |
| 830864 | 3/1960 | United Kingdom . |
| 873214 | 7/1961 | United Kingdom . |

*Primary Examiner*—P. E. Willis, Jr.

[57] ABSTRACT

Built laundry detergent compositions containing specific mixtures of selected anionic, nonionic and water-soluble cationic surfactants. The compositions are especially effective in removing greasy soil from fabrics.

9 Claims, No Drawings

DETERGENT COMPOSITIONS COMPRISING CATIONIC, ANIONIC AND NONIONIC SURFACTANTS

This application is a continuation of application Ser. No. 919,537, filed June 26, 1978 now abandoned.

BACKGROUND OF THE INVENTION

This invention relates to detergent compositions exhibiting improved greasy soil removal capabilities. More specifically, the detergent compositions of this invention provide unexpectedly good detergency performance on greasy and oily soils having a marked particulate soil content.

Cationic surfactants have been frequently incorporated into detergent compositions of various types. However, the inclusion of such cationic surfactants is generally for the purpose of providing some adjunct fabric care benefit, and not for the purpose of cleaning. For example, certain cationic surfactants have been included in detergent compositions for the purpose of yielding a germicidal or sanitization benefit to washed surfaces, as is disclosed in U.S. Pat. Nos. 2,742,434, Kopp, issued Apr. 17, 1956; 3,539,520, Cantor et al, issued Nov. 10, 1970; and 3,965,026, Lancz, issued June 22, 1976. Other cationic surfactants, such as ditallowdimethylammonium chloride, have been included in detergent compositions for the purpose of yielding a fabric-softening benefit, as disclosed in U.S. Pat. No. 3,607,763, Salmon et al, issued Sept. 21, 1971; and U.S. Pat. No. 3,644,203, Lamberti et al, issued Feb. 22, 1972. Such components are also disclosed as being included in detergent compositions for the purpose of controlling static, as well as softening laundered fabrics, in U.S. Pat. Nos. 3,951,879, Wixon, issued Apr. 20, 1976; and 3,959,157, Inamorato, issued May 25, 1976.

Compositions comprising mixtures of anionic, cationic and nonionic surfactants are also known in the art. Thus, compositions conferring enhanced antistatic character to textiles washed therewith are described in British Pat. No. 873,214 while compositions having enhanced germidical and detergency performance are disclosed in British Pat. No. 641,297.

Surprisingly, it has now been found, however, that built detergent compositions comprising water-soluble or dispersible mixtures of specific anionic, cationic and nonionic surfactants in critical relative amounts provide unexpectedly improved cleaning performance on greasy and oily soils, even where these have a high content of particulate matter. Moreover, this excellent performance is observed at both high and low wash temperatures and over a range of realistic soil types and wash conditions. Furthermore, the enhanced greasy stain removal performance is achieved without detriment to detergency performance on conventional soil and stain types and most surprisingly, without detriment to the soil suspending or fabric whitening characteristics of the compositions.

SUMMARY OF THE INVENTION

According to the present invention, there is provided a solid particulate detergent composition comprising (a) from 2% to 60% of a surfactant system consisting essentially of a water-soluble or water-dispersible combination of anionic, alkoxylated nonionic and water-soluble quaternary ammonium cationic surfactants, wherein the anionic:cationic surfactant weight ratio is no more than 5:1 and the nonionic:cationic surfactant weight ratio is in the range from 100:1 to 2:3, and wherein the surfactant system contains anionic and cationic surfactants in an equivalent ratio of at least 1:1, and (b) at least 10% of a detergency builder.

Detergent compositions of the present invention contain as an essential ingredient a three-component active system comprising anionic, alkoxylated nonionic and water-soluble cationic surfactants. This active system comprises from about 2% to about 60% by weight of the compositions. In granular laundry detergent applications, the active system is generally in the range from about 4% to about 30%, more preferably from about 6% to about 15% by weight of the compositions.

The compositions of the present invention are prefably formulated to have a pH of at least about 6 in the laundry solution at conventional usage concentrations (about 1% by weight) in order to optimize cleaning performance. More preferably, they are alkaline in nature when placed in the laundry solution and have a pH greater than about 7, especially greater than about 8. At the higher pH values, the surface activity of the compositions of the invention is enhanced and, in certain instances, is quite markedly enhanced.

In preferred systems, the anionic and cationic surfactants have a combined total of no more than 34 carbon atoms counted in hydrophobic groups having at least 4 consecutive carbon atoms (eg. alkyl, alkaryl, aryl, alkaryl, aralkyl groups etc.). In more preferred systems the number of such hydrophobic group carbon atoms totals from about 18 to 33, especially from about 26 to 32, with the anionic surfactant providing at least 12 of the carbon atoms. These hydrophobicity limitations have been found to optimize the interaction of the ternary active system with greasy and oily stains on fabrics and to correspond to compositions of maximum grease detergency effectiveness.

An essential feature of the present compositions is that the surfactant system must be substantially neutral in surfactant anions and cations or else have an ionic excess of surfactant anions over surfactant cations. This is important not only with regard to optimizing grease removal, but also for ensuring good suspension of soil in the detergent wash liquor (ie. for preventing soil redeposition) and also for ensuring that water-insoluble anionic effect agents such as anionic fluorescers retain their effectiveness in composition. It is, of course, well known, that anionic fluorescers are quenched or inhibited in effectiveness in the presence of cationic surfactants. Surprisingly, the grease and oil detergency benefits of the present invention are secured without suppression of fluorescer activity. It is accordingly highly important that the overall anionic:cationic surfactant equivalent ratio in the present compositions is, within manufacturing error, at least 1:1.

At typical composition levels, the manufacturing error in the anionic and cationic surfactant components is up to about 5% by weight for each component.

Subject to the above conditions the weight ratio of anionic:cationic surfactant can vary in the range from about 5:1 to about 1:3, especially from about 2:1 to about 1:2, the weight ratio of nonionic:cationic from about 100:1 to about 2:3, especially from about 20:1 to about 1:1, and the weight ratio of anionic:nonionic from about 7:1 to about 1:20, especially from about 2:1 to about 1:10. In terms of surfactant levels, the surfactant system preferably comprises at least about 5% by weight of the water-soluble cationic surfactant and at least about 60% by weight in total of the anionic and nonionic surfactants. In one preferred embodiment, the surfactant system comprises at least 15% by weight of each of the anionic and cationic surfactants and from 15% to 60% by weight of the nonionic surfactant. In another preferred embodiment, the surfactant system comprises at least 5% by weight of each of the anionic and cationic surfactants and at least 60% by weight of the nonionic surfactant.

As mentioned above, the cationic surfactant component of the composition of the invention is characterised as being water-soluble. By water solubility, we refer in this context to the solubility of cationic surfactant in monomeric form, the limit of solubility being determined by the onset of micellisation and measured in terms of critical micelle concentration (C.M.C.). The cationic surfactant should thus have a C.M.C. for the pure material greater than about 200 p.p.m. and preferably greater than about 500 p.p.m., specified at 30° C. and in distilled water. Literature values are taken where possible, especially surface tension or conductimetric values—see Critical Micelle Concentrations of Aqueous Surfactant Systems, P. Mukerjee and K. J. Mysels, NSRDS-NBS 36, (1971).

Another important feature is that the ternary active system itself must be water-dispersible or water-soluble in combination with the remainder of the detergent composition. This implies that, in an equilibrium aqueous mixture of the detergent composition (containing about 1000 p.p.m. of surfactant) the ternary active system exists in one or more liquid (as opposed to solid) surfactant/water phases. Expressed in another way, the surfactant system should have a Krafft point of no higher than about 25° C.

A further essential component of the present compositions is at least 10%, preferably from about 20% to about 70% by weight of a detergency builder, for example, a water-soluble inorganic or organic electrolyte. Suitable electrolytes have an equivalent weight of less than 210, especially less than 100 and include the common alkaline polyvalent calcium ion sequestering agents. Water-insoluble calcium ion exchange materials can also be used with advantage, however. Surprisingly, it is found that the grease removal performance of the present compositions depends sensitively on the ionic strength and the level of free hardness ions in the detergent liquor and these parameters must be closely controlled for optimum performance. Thus, when the compositions are used in about 1% solution, the builder: surfactant weight ratio is preferably greater than about 1:3, more preferably greater than about 4:1 and especially greater than about 8:1. The weight ratio of calcium ion sequestering or exchange agent:surfactant, on the other hand, is preferably greater than about 1:1 and especially greater than about 3:1, while the electrolyte:-surfactant weight ratio is preferably greater than about 3:1, especially greater than about 6:1.

Optimum grease and particulate detergency also depends sensitively on the choice of nonionic surfactant and especially desirable from the viewpoint of grease detergency are biodegradable nonionic surfactants having a lower consolute temperature in the range from about 25° C. to about 65° C., more preferably from about 30° C. to about 50° C. Highly suitable nonionic surfactants of this type have the general formula $RO(CH_2CH_2O)_nH$ wherein R is primary or secondary branched or unbranched $C_{9-15}$ alkyl or alkenyl and n (the average degree of ethoxylation) is from 2 to 9, especially from 3 to 8. More hydrophilic nonionic detergents can be employed for providing particulate detergency and anti-redeposition, however, for instance, nonionic detergents of the general formula given above wherein R is primary or secondary, branched or unbranched $C_{8-24}$ alkyl or alkenyl and n is from 10 to 40. Combinations of the two classes of nonionic surfactants can also be used with advantage of course.

The individual components of the composition of the invention will now be described in detail.

The Cationic Surfactant

The cationic surfactant is a water-soluble quaternary ammonium compound having a critical micelle concentration of at least 200 p.p.m. at 30° C. In structural terms, the preferred cationic surfactant comprises from 1 to about 4 quaternary ammonium groups of which only one has the general formula:

$$R^1{}_mR^2{}_xN^+$$

wherein each $R^1$ is a hydrophobic alkyl or alkenyl group optionally substituted or interrupted by phenyl, ether, ester or amide groups totalling from 8 to 20 carbon atoms and which may additionally contain up to 20 ethoxy groups, m is a number from 1 to 3 and no more than one $R^1$ can have more than 16 carbon atoms when m is 2 and no more than 12 carbon atoms when m is 3, each $R^2$ is an alkyl group containing from one to four carbon atom or a benzyl group with no more than one $R^2$ in a molecule being benzyl, x is from 0 to 3, and the sum of m and x is no more than 4.

A highly preferred group of cationic surfactants of this type have the general formula:

$$R^1{}_mR^2{}_{4-m}N^+Z$$

wherein $R^1$ is selected from $C_8$–$C_{20}$ alkyl, alkenyl and alkaryl groups; $R^2$ is selected from $C_{1-4}$ alkyl and benzyl groups; Z is an anion in number to give electrical neutrality; and m is 1, 2 or 3; provided that when m is 2, $R^1$ has less than 15 carbon atoms and when m is 3, $R^1$ has less than 9 carbon atoms.

Where m is equal to 1, it is preferred that $R^2$ is a methyl group. Preferred compositions of this mono-long chain type include those in which $R^1$ is a $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chains should have less than 14 carbon atoms. Thus, ditallowdimethylammonium chloride and distearyldimethylammonium chloride, which are used conventionally as fabric softeners and static control agents in detergent compositions, may not be used as the cationic component in the surfactant mixtures of the present invention. Particularly preferred cationic materials of this class include di-$C_8$ alkyldimethylammonium halide and di-$C_{10}$ alkyldimethylammonium halide materials.

Where m is equal to 3, the $R^1$ chains should be less than 9 carbon atoms in length. An example is trioctylmethyl ammonium chloride. The reason for this chain length restriction, as is also the case with the di-long chain cationics described above, is the relative insolubility of these tri- and di-long chain materials.

Another group of useful cationic compounds are the polyammonium salts of the general formula:

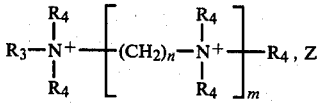

wherein $R_3$ is selected from $C_8$ to $C_{20}$ alkyl, alkenyl and alkaryl groups; each $R_4$ is $C_1$–$C_4$ alkyl; n is from 1 to 6; and m is from 1 to 3.

A specific example of a material in this group is:

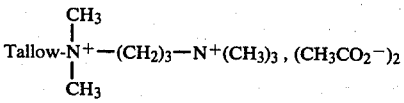

(1)

A further preferred type of cationic component, which is described in U.S. Patent Application Ser. No. 811,218 Letton, filed June 29, 1977, and incorporated herein by reference, has the formula:

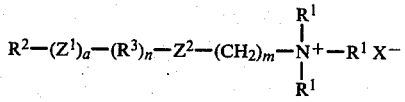

wherein $R^1$ is $C_1$ to $C_4$ alkyl; $R^2$ is $C_5$ to $C_{30}$ straight or branched chain alkyl or alkenyl, alkyl benzene, or

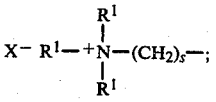

wherein s is from 0 to 5, $R^3$ is $C_1$ to $C_{20}$ alkyl or alkenyl; a is 0 or 1; n is 0 or 1; m is from 1 to 5; $Z^1$ and $Z^2$ are each selected from the group consisting of:

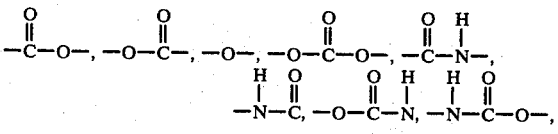

and wherein at least one of said groups is selected from the group consisting of ester, reverse ester, amide and reverse amide; and X is an anion which makes the compound water-soluble, preferably selected from the group consisting of halide, methyl sulfate, hydroxide, and nitrate preferably chloride, bromide or iodine.

In addition to the advantages of the other cationic surfactants disclosed herein, this particular cationic component is environmentally desirable, since it is biodegradable, both in terms of its long alkyl chain and its nitrogen-containing segment.

Particularly preferred cationic surfactants of this type are the choline ester derivatives having the following formula:

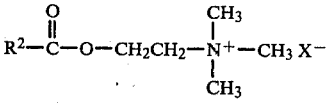

as well as those wherein the ester linkage in the above formula is replaced with a reverse ester, amide or reverse amide linkage.

Particularly preferred examples of this type of cationic surfactant include caproyl choline ester quaternary ammonium halides ($R^2=C_9$ alkyl), palmitoyl choline ester quaternary ammonium halides ($R^2=C_{15}$ alkyl), myristoyl choline ester quaternary ammonium halides ($R^2=C_{13}$ alkyl), lauroyl chloine ester ammonium halides ($R^2=C_{11}$ alkyl), and capryloyl choline ester quaternary ammonium halides ($R^2=C_7$ alkyl).

Additional preferred cationic components of the choline ester variety are given by the structural formulas below, wherein p may be from 0 to 20.

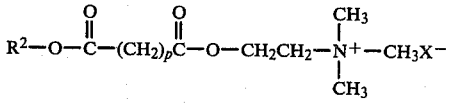

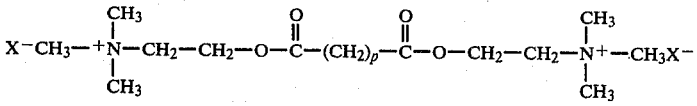

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize triethanolamine, forming the desired cationic component.

Another type of novel particularly preferred cationic material, described in U.S. Patent Application Ser. No. 811,219 Letton, filed June 29, 1977 and incorporated herein by reference, are those having the formula:

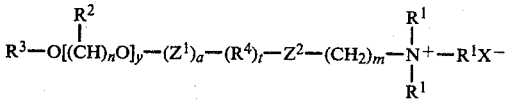

In the above formula, each $R^1$ is a $C_1$ to $C_4$ alkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenyl, or alkyl benzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1; t may be 0 or 1; and m is from 1 to 5, preferably 2. $Z^1$ and $Z^2$ are each selected from the group consisting of

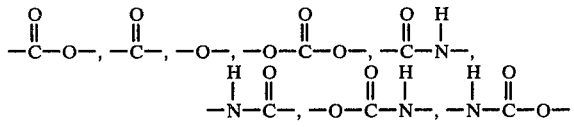

and wherein at least one of said groups is selected from the group consisting of ester, reverse ester, amide and reverse amide. X is an anion which will make the compound water-soluble and is selected from the group consisting of halides, methylsulfate, hydroxide and nitrate, particularly chloride, bromide and iodide.

These surfactants, when used in the compositions of the present invention, yield excellent particulate soil, body soil, and grease and oil soil removal. In addition, the detergent compositions control static and soften the fabrics laundered therewith, and inhibit the transfer of dyes in the washing solution. Further, these novel cationic surfactants are environmentally desirable, since both their long chain alkyl segments and their nitrogen segments are biodegradable.

Preferred embodiments of this type of cationic component are the choline esters ($R^1$ is a methyl group and $Z^2$ is an ester or reverse ester group), particular formulas of which are given below by which t is 0 or 1 and y is from 1 to 20.

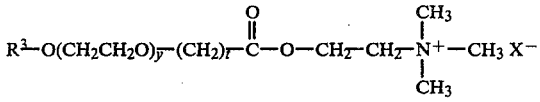

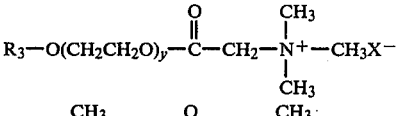

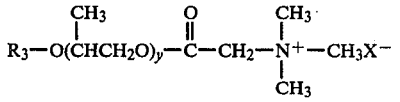

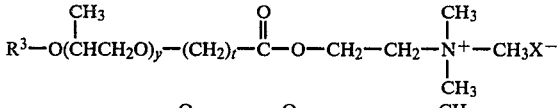

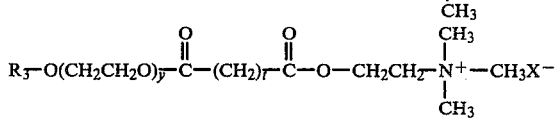

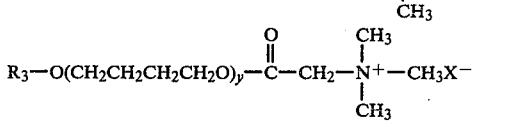

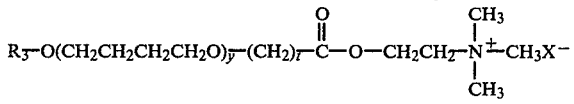

The preferred choline derivatives, described above, may be prepared by the reaction of a long chain alkyl polyalkoxy (preferably polyethoxy) carboxylate, having an alkyl chain of desired length, with oxalyl chloride, to form the corresponding acid chloride. The acid chloride is then reacted with dimethylaminoethanol to form the appropriate amine ester, which is then quaternized with a methyl halide to form the desired choline ester compound. Another way of preparing these compounds is by the direct esterification of the appropriate long chain ethoxylated carboxylic acid together with 2-haloethanol or dimethyl aminoethanol, in the presence of heat and an acid catalyst. The reaction product formed is then quaternized with methylhalide or used to quaternize trimethylamine, forming the desired cationic component.

The Anionic and Nonionic Surfactant

A typical listing of anionic and nonionic surfactants useful herein appears in U.S. Pat. No. 3,925,678 incorporated herein by reference. The following list of detergent compounds which can be used in the instant compositions is representative of such materials.

Water-soluble salts of the higher fatty acids, ie. "soaps", are useful as the anionic detergent component of the compositions herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

A highly preferred class of anionic detergents includes water-soluble salts, particularly the alkali metal, ammonium and alkylolammonium salts, of organic sulfuric reaction products having in their molecular structure an alkyl group containing from about 8 to about 22, especially from about 10 to about 20 carbon atoms and a sulfonic acid or sulfuric acid ester group. (Included in the term "alkyl" is the alkyl portion of acyl groups). Examples of the detergent compositions of the present invention are the sodium and potassium alkyl sulfates, especially those obtained by sulfating the higher alcohols $C_8$–$C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g. those of the type described in U.S. Pat. Nos. 2,220,099 and 2,477,383. Especially valuable are linear straight chain alkyl benzene sulfonates in which the average of the alkyl group is about 11.8 carbon atoms, abbreviated as $C_{11.8}$ LAS.

A preferred alkyl ether sulfate surfactant component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 mols of ethylene oxide.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts of esters of α-sulfonated fatty acids containing from about 6 to 20 carbon atoms in the fatty acid group and from about 1 to 10 carbon atoms in the ester group; water-insoluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; water-soluble salts of paraffin sulfonates containing from about 8 to 24, especially 14 to 18 carbon atoms, and β-alkyloxy alkane sulfonates containing from about 1 to 3 carbon atoms in the alkyl group and from about 8 to 20 carbon atoms in the alkane moiety.

Anionic surfactant mixtures can also be employed, for example 5:1 to 1:5 mixtures of an alkyl benzene sulfonate having from 9 to 15 carbon atoms in the alkyl radical and mixtures thereof, the cation being an alkali metal preferably sodium; and from about 2% to about 15% by weight of an alkyl ethoxy sulfate having from 10 to 20 carbon atoms in the alkyl radical and from 1 to 30 ethoxy groups and mixtures thereof, having an alkali metal cation, preferably sodium. The nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic detergents include:

1. The polyethylene oxide condensates of alkyl phenol, eg. the condensation products of alkyl phenols having an alkyl group containing from 6 to 12 carbon atoms in either a straight chain or branched chain configuration, with ethylene oxide, the said ethylene oxide being present in amounts equal to 1 to 40 moles, preferably from 2 to 9 moles of ethylene oxide per mole of alkyl phenol. The alkyl substitutent in such compounds may be derived, for example, from polymerised propylene, di-isobutylene, octane or nonene. Other examples include dodecylphenol condensed with 12 moles of ethylene oxide per mole of phenol; dinonylphenol condensed with 5 moles of ethylene oxide per mole of phenol; nonylphenol condensed with 9 moles of ethylene oxide per mole of nonylphenol and di-iso-octylphenol condensed with 5 moles of ethylene oxide.

2. The condensation product of primary or secondary aliphatic alcohols having from 8 to 24 carbon atoms, in either straight chain or branched chain configuration, with from 1 to about 40 moles of alkylene oxide per mole of alcohol. Preferably, the aliphatic alcohol comprises between 9 and 15 carbon atoms and is ethoxylated with between 2 and 9 desirably between 3 and 8 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulphonates. The preferred surfactants are prepared from primary alcohols which are either linear (such as those derived) from natural fats of prepared by the Ziegler process from ethylene, eg. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperionic is a trade name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-11, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 16 carbon atoms in the alkyl group and up to about 11, especially from about 3 to 9, ethoxy residues per molecule.

3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the trade name of "Pluronic" supplied by Wyandotte Chemicals Corporation.

A highly preferred mixture of surfactants is a mixture of a $C_8$–$C_{22}$ alkyl benzene sulfonate and a $C_9$–$C_{15}$ alkanol ethoxylated with from 3 to 8 moles of ethylene oxide per mole of alkanol. Highly preferred mixtures include $C_{12}$ alkyl benzene sulfonate and $C_{14}$–$C_{15}$ alcohol-(7)-ethoxylate, in ratios of from 2:1 to 1:10, preferably 1:1 to 1:8. In still more preferred compositions, $C_8$–$C_{24}$ alkanol ethoxylate with from 10 to 40 moles of ethylene oxide per mole of alkanol is added to the above-described mixture, preferably at a level of from 1% to 5%.

The Builder

The Detergent composition of the invention also contains at least about 10% of a detergency builder, especially a water-soluble inorganic or organic electrolyte. Suitable electrolytes have an equivalent weight of less than 210, especially less than 100 and include the common alkaline polyvalent calcium ion sequestering agents. The builder can also include water-insoluble calcium ion exchange materials, however, nonlimiting examples of suitable water-soluble, inorganic detergent builders include: alkali metal carbonates, borates, phosphates, polyphosphates, bicarbonates, silicates, sulfates and chlorides. Specific examples of such salts include sodium and potassium tetraborates, perborates, bicarbonates, carbonates, tripolyphosphates, orthophosphates, pyrophosphates, hexametaphosphates and sulfates.

Examples of suitable organic alkaline detergency builders include: (1) water-soluble amino carboxylates and aminopolyacetates, for example, sodium and potassium glycinates, ethylenediamine tetraacetates, nitrilotriacetates, and N-(2-hydroxyethyl)nitrilo diacetates and diethylenetriamine pentaacetates; (2) water-soluble salts of phytic acid, for example, sodium and potassium phytates; (3) water-soluble polyphosponates, including sodium, potassium, and lithium salts of ethane-1-hydroxy-1,1-diphosphonic acid; sodium, potassium, and lithium salts of ethylene diphosphonic acid; and the like.

(4) water-soluble polycarboxylates such as the salts of lactic acid, succinic acid, malonic acid, maleic acid, citric acid, carboxymethyloxysuccinic acid, 2-oxa-1,1,3-propane tricarboxylic acid, 1,1,2,2-ethane tetracarboxylic acid, cyclopentane-cis, cis, cis-tetracarboxylic acid, mellitic acid and pyromellitic acid; (5) water-soluble organic amines and amine salts such as monoethanolamine, diethanolamine and triethanolamine and salts thereof.

Mixtures of organic and/or inorganic builders can be used herein. One such mixture of builders is disclosed in Canadian Patent No. 755.038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprises a water-soluble material capable of forming a water-insoluble reaction product with water hardness cations preferably in combination with a crystallization seed which is capable of providing growth sites for said reaction product. Such "seeded builder" compositions are fully disclosed in British patent specification No. 1,424,406.

A further class of detergency builder materials useful in the present invention are insoluble sodium aluminosilicates, particularly those described in Belgium Pat. No. 814,874, issued Nov. 12, 1974, incorporated herein by reference. This patent discloses and claims detergent compositions containing sodium aluminosilicates having the formula $$Na_z(AlO_2)_z(SiO_2)_yXH_2O,$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram. A preferred material is $$Na_{12}(SiO_2AlO_2)_{12}27H_2O$$

Additional Ingredients

The compositions of the present invention can be supplemented by all manner of detergent components, either by including such components in the aqueous slurry to be dried or by admixing such components with the compositions of the invention following the drying step. Soil suspending agents at about 0.1% to 10% by weight such as water-soluble salts of carboxymethylcellulose, carboxyhydroxymethyl cellulose, and polyethylene glycols having a molecular weight of about 400 to 10,000 are common components of the present invention. Dyes, pigment optical brighteners, and perfumes can be added in varying amounts as desired.

Other materials such as fluorescers, enzymes in minor amounts, anti-caking agents such as sodium sulfosuccinate, and sodium benzoate can also be added. Enzymes suitable for use herein include those discussed in U.S. Pat. Nos. 3,519,570 and 3,533,139 to McCarty and McCarty et al issued July 7, 1970 and Jan. 5, 1971, respectively.

Anionic fluorescent brightening agents are well-known materials, examples of which are disodium 4,4'-bis-(2-diethanolamino-4-anilino-s-triazin-6-ylamino)stilbene-2:2'disulphonate, disodium 4,4'-bis-(2-morpholino-4-anilino-s-triazin-6-ylaminostilbene-2:2'-disulphonate, disodium 4,4'-bis-(2,4-dianilino-s-triazin-6-ylamino)stilbene-2:2'-disulphonate, disodium 4,4'-bis-(2-anilino-4-(N-methylN-2-hydroxyethylamino)-s-triazin-6-ylamino)stilbene-2,2'-disulphonate, disodium 4,4'-bis-(4-phenyl-2,1,3-triazol-2-yl)-stilbene-2,2'disulphonate, disodium 4,4'bis(2-anilino-4-(1-methyl-2-hydroxyethylamino)-s-triazin-6-ylamino)stilbene-2,2'-disulphonate and sodium 2(stilbyl-4''-(naphtho-1',2':4,5)-1,2,3-triazole-2''-sulphonate.

An alkali metal, or alkaline earth metal, silicate can also be present. The alkali metal silicate preferably is used in an amount from 0.5% to 10% preferably from 3% to 8%. Suitable silicate solids have a molar ratio of $SiO_2$/alkali metal$_2$O in the range from about 0.5 to about 4.0, but much more preferably from 1.0 to 1.8, especially about 1.6. The alkali metal silicates suitable herein can be commercial preparations of the combination of silicon dioxide and alkali metal oxide, fused together in varying proportions.

The compositions of this invention can require the presence of a suds regulating or suppressing agent.

Suds regulating components are normally used in an amount from about 0.001% to about 5%, preferably from about 0.05% to about 3% and especially from about 0.10% to about 1%. The suds suppressing (regulating) agents which are known to be suitable as suds suppressing agents in detergent context can be used in the compositions herein. These include the silicone suds suppressing agents, especially the mixtures of silicones and silica described in U.S. Pat. No. 3,933,672, the disclosure of which is incorporated herein by reference. A particularly preferred suds suppressor is the material known as "HYFAC", the sodium salt of a long-chain ($C_{20}$–$C_{24}$) fatty acid.

Microcrystalline waxes having a melting point in the range from 35° C.–115° C. and saponification value of less than 100 represent an additional example of a preferred suds regulating component for use in the subject compositions. The microcrystalline waxes are substantially water-insoluble, but are water-dispersible in the presence of organic surfactants. Preferred microcrystalline waxes having a melting point from about 65° C. to 100° C., a molecular weight in the range from 400–1000; and a penetration value of at least 6, measured at 77° C. by ASTM-D1321. Suitable examples of the above waxes include microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

The granular detergent compositions herein can also advantageously contain a peroxy bleaching component in an amount from about 3% to about 40% by weight, preferably from about 8% to about 33% by weight. Examples of suitable peroxy bleach components for use herein include perborates, persulfates, persilicates, perphosphates, percarbonates, and more in general all inorganic and organic peroxy bleaching agents which are known to be adapted for use in the subject compositions. The composition can also advantageously include a bleach activator which is normally an organic compound containing an N-acyl, or an O-acyl (preferably acetyl) group. Preferred materials are N,N,N',N'-tetraacetyl ethylene diamine and N,N,N',N'-tetraacetylglycouril.

A further preferred ingredient of the instant compositions is from about 0.01 to about 4%, especially from about 0.5 to about 2.2% by weight of a polyphosphonic acid or salt thereof which is found to provide bleachable stain detergency benefits.

Especially preferred polyphosphonates have the formula:

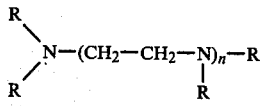

wherein each R is $CH_2PO_3H_2$ or a water-soluble salt thereof and n is from 0 to 2. Examples of compounds within this class are aminotri-(methylenephosphonic acid), aminotri-(ethylidenephosphonic acid), ethylene diamine tetra (methylenephosphonic acid) and diethylene triamine penta (methylene phosphonic acid). Of these, ethylene diamine tetra(methylene phosphonic acid) is particularly preferred.

A further optional, though preferred component is from about 0.1% to about 3%, especially from about 0.25% to about 1.5% of a polymeric material having a molecular weight of from 2000 to 2,000,000 and which is a copolymer of maleic acid or anhydride and a polymerisable monomer selected from compounds of formula:

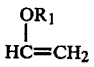

(i)

wherein $R_1$ is $CH_3$ or a $C_2$ to $C_{12}$ alkyl group;

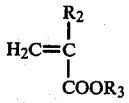

(ii)

wherein $R_2$ is H or $CH_3$ and $R_3$ is H, or a $C_1$ to $C_{10}$ alkyl group;

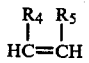

(iii)

wherein each of $R_4$ and $R_5$ is H or an alkyl group such that $R_4$ and $R_5$ together have 0 to 10 carbon atoms;

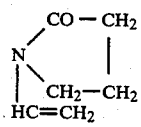

(iv)

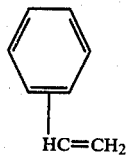

(v)

and (vi) mixtures of any two or more thereof, said copolymers being optionally wholly or partly neutralised at the carboxyl groups by sodium or potassium.

Highly preferred examples of such carboxylates are 1:1 styrene/maleic acid copolymer, di-isobutylene/-maleic acid copolymers and methyl vinyl ether/maleic acid copolymers.

Other suitable polycarboxylates are poly-α-hydroxy acrylic acids of the general formula $$-[-CR_1R_2-C(OH)-(COOH)-]_n-$$

wherein $R_1$ and $R_2$ each represent a hydrogen atom or an alkyl group containing 1, 2 or 3 carbon atoms and wherein n represents an integer greater than 3. Such materials may be prepared as described in Belgium Pat. No. 817,678. Also suitable are polylactones prepared from the hydroxy acids as described in British Pat. No. 1,425,307.

When used in commercial laundry or household washing machines, the compositions of the invention are used as aqueous solutions containing from about 100 to about 3000 p.p.m., especially from about 500 to 1500 p.p.m. of surfactant.

In a process aspect of the invention, there is provided a method of making the detergent composition of the invention comprising the steps of spray drying a crutcher mix containing the anionic, cationic and builder components and subsequently absorbing the nonionic surfactant in liquid or molten form into the spray-dried granules. This process is particularly valuable when the builder comprises an aluminosilicate ion-exchange material.

In another process aspect of particular applicability to compositions comprising aluminosilicate builder, the nonionic is included in the crutcher mix for spray drying, but the components of the surfactants are premixed before addition of the aluminosilicate.

Other processes of making the compositions of the invention can be employed, of course. Thus the anionic and nonionic surfactants and the builder and filler components can be spray dried in conventional manner to form a base powder composition and the cationic component can then be added to the base powder either as an approximately 1:1 mixture with part of the builder or filler components retained for that purpose, or as an inclusion complex of, for instance, urea. Alternatively, the cationic surfactant can be sprayed onto the base powder, or added as a dry mixed prill agglomerated with an inorganic or organic agglomerating aid, or can be separately spray dried and added to the base powder as a dry mixed granule. Alternatively, the cationic surfactant and base powder compositions can be individually spray dried in separate stages of a multi-stage spray drying tower.

The compositions of the invention can also be provided in the form of two or more component products, which are either mixed before use or added separately to a laundry solution to provide a concentration of the ternary surfactant system of from about 100 to about 3000 p.p.m., especially from about 500 to about 1500 p.p.m. Each component product includes one or more of the active ingredients of the ternary surfactant system and a mixture of the products in prescribed amounts should have the requisite granular form. In a preferred embodiment, one product is formulated as a conventional anionic or nonionic detergent composition suitable for use in the main wash cycle of an automatic laundry or washing machine, and the other is formulated as a cationic containing additive or booster product for use simultaneously with the conventional detergent during the main wash. In addition to the cationic, the additive product will contain nonionic and/or anionic surfactant such that the total composition formed by mixing the component products in specified amounts has the requisite ternary active system.

The compositions of the invention can also be formulated as special prewash compositions designed for used before the main wash stage of the conventional laundering cycle. Such prewash compositions will normally consist of a single product component containing the defined ternary active system.

In the Examples which follow, the abbreviations used have the following designations:

LAS: Linear $C_{12}$ alkyl benzene sulfonate

TAS: Tallow alkyl sulfate $TAE_n$: Tallow alcohol ethoxylated with n moles of ethylene oxide per mole alcohol MTMAC: Myristyl trimethyl ammonium chloride LTMAC: Lauryl trimethyl ammonium chloride Dobanol 45-E-7: A $C_{14}$–$C_{15}$ oxo-alcohol with 7 moles of ethylene oxide, marketed by Shell Dobanol 45-E-3: A $C_{14}$–$C_{15}$ oxo-alcohol with 3 moles of ethylene oxide, marketed by Shell.

Silicate: Sodium silicate having an $SiO_2$:$Na_2O$ ratio of 1.6.

Wax: Microcrystalline wax-Witcodur 272 M.pt 87° C.

Silicone: Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide.

Gantrez AN119: Trade name for maleic anhydride/-vinyl methyl ether copolymer, believed to have an average molecular weight of about 240,000, marketed by GAF. This was prehydrolysed with NaOH before addition.

Brightener: Disodium 4,4'-bis-(2-morpholino-4-anilino-s-triazin-6-ylamino)stilbene-2:2';disulphonate.

TAED: Tetraacetyl ethylene diamine

Dequest 2060: Trade name for diethylene triamine penta (methylene phosphonic acid,) marketed by Monsanto Dequest 2040: Trade Name for ethylenediamine tetra (methylene phosphonic acid,) marketed by Monsanto.

The level of Zeolite A is given on an anhydrous basis; the material contains 21% water of crystallisation.

The present invention is illustrated by the following non-limiting examples.

EXAMPLES 1–5

The following compositions were prepared by spray-drying an aqueous slurry of the ingredients except for the Dobanol derived nonionic surfactants which were sprayed onto the spray-dried granules, and the sodium perborate and enzyme which were dry mixed into the composition.

EXAMPLES

| | 1 % | 2 % | 3 % | 4 % | 5 % |
|---|---|---|---|---|---|
| LAS | 7 | 8 | 13 | 3 | 4 |
| MTMAC | 2.25 | 5 | 4 | — | — |
| LTMAC | — | — | — | 2 | 1.5 |
| Dobanol 45-E-7 | 2.25 | 4 | 3 | — | 2 |
| Dobanol 45-E-4 | — | — | — | — | 2 |
| $TAE_{11}$ | — | 1 | 3.5 | — | — |
| $TAE_{25}$ | — | — | — | 3 | — |
| $C_{22}$ Soap | — | 4 | 2 | — | — |
| Pentasodium tripolyphosphate | 4 | 20 | 0.5 | 18 | — |
| Disodium pyrophosphate | — | — | — | — | 18 |

EXAMPLES-continued

| | 1 % | 2 % | 3 % | 4 % | 5 % |
|---|---|---|---|---|---|
| Zeolite A (particle size 5μ) | 40 | 26 | 45 | — | — |
| Gantrez AN119 | — | — | — | 1.5 | 1 |
| Dequest 2060 | — | — | — | 1 | 1 |
| Silicate | — | 5 | — | 5 | 6 |
| Protease enzyme | 0.8 | 0.5 | 0.8 | — | — |
| Sodium perborate | — | 32 | — | 25 | 20 |
| Silicone | — | — | — | 2 | 2 |
| Wax | 2.0 | — | — | 0.3 | 0.3 |
| Brightener | 0.15 | 0.15 | 0.15 | 0.15 | 0.15 |
| Sodium sulphate, moisture and miscellaneous | | | to 100 | | |

These products provide enhanced oil and grease stain removal performance without detriment to particle clay soil detergency, whiteness maintenance and fluorescer brightening characteristics on both natural and man-made fabrics at both high and low wash temperatures.

Products with enhanced performance are also obtained when the sodium alkyl benzene sulphonate is replaced by molar equivalents of $C_{10}$–$C_{22}$ olefine sulphonates, $C_{10}$–$C_{20}$ paraffin sulphonates, and $C_{10}$–$C_{20}$ alkyl ether sulphates.

The lauryl or myristyl trimethyl ammonium chloride in the above examples can be replaced by molar equivalents of lauryl or myristyl-trimethyl ammonium bromide, decyl trimethyl ammonium chloride, dioctyl dimethyl ammonium bromide, coconut alkyl benzyl dimethyl ammonium chloride, $C_{12}$ alkylbenzyl dimethyl ethyl ammonium chloride, $C_{12}$ alkylbenzyl trimethyl ammonium chloride or one of the following compounds $$C_{12}H_{25}-O-(CH_2)_3-COOCH_2CH_2-\overset{\overset{CH_3}{|}}{\underset{\underset{CH_3}{|}}{N}}{}^{(+)}-CH_3\,,\ Cl^{(-)}$$

$$C_{14}H_{29}-O-CH_2CH_2OCOCH_2-\overset{\overset{CH_3}{|}}{\underset{\underset{CH_3}{|}}{N}}{}^{(+)}-CH_3\,,\ Cl^{(-)}$$

$$C_{14}-OCH_2CH_2O-CO(CH_2)_3COOCH_2CH_2-\overset{\overset{CH_3}{|}}{\underset{\underset{CH_3}{|}}{N}}{}^{(+)}-CH_3\,,\ Br^{(-)}$$

EXAMPLES 6–11

The following compositions were prepared similarly to Examples 1–5.

| | 6 | 7 | 8 | 9 | 10 | 11 |
|---|---|---|---|---|---|---|
| LAS | 1.2 | 2.2 | — | 5.0 | 2.2 | 2.0 |
| MTMAC | 1.0 | 1.8 | 2.8 | 2.0 | 1.8 | 1.6 |
| TAS | — | — | 3.0 | — | — | — |
| Dobanol 45-E-7 | 8.0 | 6.6 | — | 1.5 | 6.6 | 3.0 |
| $TAE_{11}$ | — | — | 6.0 | — | — | 1.0 |
| Dobanol 45-E-4 | — | — | 3.0 | 2.0 | — | — |
| $C_{12}$ soap | — | 2.0 | — | — | — | — |
| $C_{18}$ soap | — | — | 0.75 | — | — | — |
| Sodium tripolyphosphate | 33.0 | 2.5 | 4.0 | 20.0 | 4.0 | 33.0 |
| Zeolite A | — | — | 20.0 | — | — | — |
| Zeolite X | — | 30.0 | — | — | — | — |
| Gantrez AN119 | — | — | — | — | 1.5 | 0.5 |
| Dequest 2040 | — | — | — | — | 1.0 | 0.5 |
| Dequest 2060 | 2.0 | — | — | 1.0 | — | — |
| Protease enzyme | 1.2 | 0.5 | 1.2 | 0.5 | 1.2 | 0.5 |
| Sodium perborate | 12.0 | 10.0 | 12.0 | 5.0 | — | 10.0 |

-continued

| | 6 | 7 | 8 | 9 | 10 | 11 |
|---|---|---|---|---|---|---|
| Sodium bicarbonate | — | — | — | — | 10.0 | — |
| Polyethylene glycol (Mo. Wt. 6000) | — | 1.0 | 1.5 | — | 1.0 | — |
| Silicone | — | — | — | 2.0 | — | — |
| TAED | 2.0 | — | 4.0 | — | — | — |
| Brightener | 0.15 | 0.15 | 0.15 | 0.15 | 0.15 | 0.15 |
| Sodium silicate ($SiO_2$:$Na_2O$ = 2:1) | 5.0 | 1 | 2.5 | 6.0 | — | — |
| Wax | 0.3 | — | — | 0.3 | — | 0.3 |
| Sodium sulphate, moisture miscellaneous | | | to 100 | | | |

These products provide enhanced oil and grease stain removal performance without detriment to particulate clay soil detergency, whiteness maintenance and fluorescer brightening characteristics on both natural and man-made fabrics at both high and low wash temperatures.

Products with enhanced performance are also obtained when the Dobanol 45-E-7 is replaced by a $C_{14-15}$ alcohol polyethoxylate containing an average of 6 moles of ethylene oxide, a $C_{12-15}$ alcohol polyethoxylate containing an average of 6.5 moles of ethylene oxide, a $C_{9-11}$ alcohol polyethoxylate containing an average of 6 moles of ethylene oxide, a $C_{12-13}$ alcohol polyethoxylate containing an average of 5 moles of ethylene oxide stripped so as to remove lower ethoxylate and unethoxylated fractions, a secondary $C_{15}$ alcohol polyethoxylate containing an average of 9 moles of ethylene oxide, a $C_{12}$ alcohol polyethoxylate containing an average of 5 moles of ethylene oxide, a $C_{10}$ alcohol polyethoxylate containing an average of 5 moles of ethylene oxide, a $C_{14}$ alcohol polyethoxylate containing an average of 6 moles of ethylene oxide, a $C_{12}$ alcohol polyethoxylate containing an average of 7 moles of ethylene oxide, and mixtures of those surfactants.

Enhanced performance is also obtained when Gantrez AN 119 replaced by, as their sodium salts, a copolymer of methyl methacrylate and maleic acid, the molar ratio of the monomers being about 1:1, of molecular weight about 10,000; an ethylene-maleic acid copolymer of molecular weight about 4,000, a propylene-maleic acid copolymer of molecular weight about 30,000; 1-hexene-maleic acid copolymer of molecular weight about 30,000; 1-hexene-maleic acid copolymer of molecular weight about 25,000; a vinyl pyrrolidone-maleic acid copolymer of molecular weight about 26,000 a styrene-maleic acid copolymer of acrylic acid and itaconic acid; a 1:4 copolymer of 3-butenoic acid and methylenemalonic acid; a 1:1.9 copolymer of methacrylic acid and aconitic acid; and a 1.2:1 copolymer of 4-pentenoic acid and itaconic acid.

Products with enhanced performance are also obtained when the sodium alkyl benzene sulphonate is replaced by molar equivalents of $C_{10}$–$C_{22}$ olefine sulphonates, $C_{10}$–$C_{20}$ paraffin sulphonates, and $C_{10}$–$C_{20}$ alkyl ether sulphates.

The myristyl trimethyl ammonium chloride in the above examples can be replaced by molar equivalents of lauryl or myristyl-trimethyl ammonium bromide, decyl trimethyl ammonium chloride, dioctyl dimethyl ammonium bromide, coconut alkyl benzyl dimethyl ammonium chloride, $C_{12}$ alkylbenzyl dimethyl ethyl ammonium chloride, $C_{12}$ alkylbenzyl trimethyl ammonium chloride or one of the following compounds

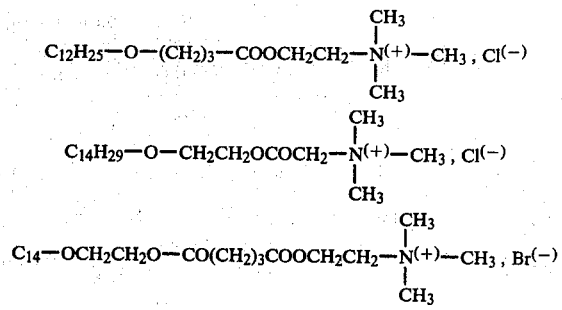

What is claimed is:

1. A solid particulate detergent composition comprising:

(a) from 2% to 60% of a surfactant system consisting essentially of a water-soluble combination of anionic, alkoxylated nonionic and quaternary ammonium cationic surfactants, wherein the anionic:cationic surfactant weight ratio is no more than 5:1 and the nonionic:cationic surfactant weight ratio is in the range from 100:1 to 2:3 and wherein the surfactant system contains anionic and cationic surfactants in an equivalent ratio of at least 1:1, wherein said quaternary ammonium cationic surfactant is selected from the group consisting of quaternary ammonium salts having one fatty alkyl group containing from 12 to 14 carbon atoms and three groups which are methyl or benzyl with no more than one of said groups being benzyl, and mixtures of said salts;

(b) at least 10% of detergency builder.

2. The composition according to claim 1, wherein the quaternary ammonium cationic surfactant is selected from the group consisting of quaternary ammonium salts having one fatty alkyl group containing from 12 to 14 carbon atoms and three groups which are methyl, and mixtures thereof.

3. The composition according to claim 1, wherein the quaternary ammonium cationic surfactant is selected from the group consisting of quaternary ammonium salts having one fatty alkyl group containing from 12 to 14 carbon atoms, two groups which are methyl and one group which is benzyl, and mixtures thereof.

4. The composition according to claim 1, wherein the anionic:cationic surfactant weight ratio is in the range from 5:1 to 1:3 and the nonionic:cationic surfactant weight ratio is in the range from about 20:1 to about 1:1.

5. The composition according to claim 4, wherein the anionic surfactant is selected from the group consisting of alkyl benzene sulfonates having from 9 to 15 carbon atoms in the alkyl group, alkyl sulfates having from 8 to 18 carbon atoms in the alkyl group, alkyl ether sulfates having an average alkyl chain with the range from about 12 to 16 carbon atoms and an average degree of ethoxylation of from about 1 to 4 moles of ethylene oxide, and mixtures thereof, and the nonionic surfactant is selected from the group consisting of condensation products of aliphatic alcohols having from 9 to 15 carbon atoms with from 3 to 8 moles of ethylene oxide per mole of alcohol.

6. The composition according to claim 5, wherein the quaternary ammonium cationic surfactant is selected from the group consisting of quaternary ammonium salts having one fatty alkyl group containing from 12 to 14 carbon atoms and three groups which are methyl, and mixtures thereof.

7. The composition according to claim 6, wherein the anionic surfactant is selected from the group consisting of alkyl benzene sulfonates having about 12 carbon atoms in the alkyl group, $C_{8-18}$ alkyl sulfates, $C_{14-15}$ alkyl ether sulfates, and mixtures thereof, and wherein the nonionic surfactant is selected from the group consisting of $C_{12-15}$ alcohol polyethoxylates containing an average of 6.5 moles of ethylene oxide and mixtures thereof and wherein the builder is selected from the group consisting of alkali metal carbonates, alkali metal polyphosphates, and mixtures thereof, and wherein the weight ratio of anionic:cationic:nonionic is 2:1:1.

8. The composition according to claim 5, wherein the quaternary ammonium cationic surfactant is selected from the group consisting of quaternary ammonium salts having one fatty alkyl group containing from 12 to 14 carbon atoms, two groups which are methyl and one group which is benzyl, and mixtures thereof.

9. The composition according to claim 8, wherein the anionic surfactant is selected from the group consisting of alkyl benzene sulfonates having about 12 carbon atoms in the alkyl group, $C_{8-18}$ alkyl sulfates and mixtures thereof, and wherein the nonionic surfactant is selected from the group consisting of $C_{12-15}$ alcohol polyethoxylates containing an average 6.5 moles of ethylene oxide, and mixtures thereof and wherein the builder is selected from the group consisting of alkali metal carbonates, alkali metal polyphosphates and mixtures thereof and wherein the weight ratio of anionic:cationic:nonionic is 2:1:1.

* * * * *